US006749062B1

(12) United States Patent
Meissner

(10) Patent No.: US 6,749,062 B1
(45) Date of Patent: Jun. 15, 2004

(54) EMBROIDERABLE GOLF BAG AND METHOD

(76) Inventor: Thomas William Meissner, 6614 N. 13th St., Phoenix, AZ (US) 85014

( * ) Notice: Subject to any disclaimer, the term of this patent is extended or adjusted under 35 U.S.C. 154(b) by 0 days.

(21) Appl. No.: 10/310,090

(22) Filed: Dec. 4, 2002

(51) Int. Cl.[7] ..... A63B 55/00; B23P 17/00

(52) U.S. Cl. ..... 206/315.3; 206/315.4; 206/315.5; 29/425; 29/525.03

(58) Field of Search ..... 206/315.3, 315.4, 206/315.5; 150/159; 29/425, 525.03

(56) References Cited

U.S. PATENT DOCUMENTS

| | | | | | |
|---|---|---|---|---|---|
| 1,616,446 | A | * | 2/1927 | Fredette | 206/315.5 |
| 2,507,249 | A | * | 5/1950 | Dorazio | 206/315.8 |
| 3,316,951 | A | * | 5/1967 | Jacobson | 206/315.3 |
| 3,674,072 | A | * | 7/1972 | Shuto | 206/315.6 |
| 3,901,299 | A | * | 8/1975 | Picco | 206/315.4 |
| 4,249,586 | A | * | 2/1981 | Setani | 206/315.4 |
| 4,282,912 | A | * | 8/1981 | Brown | 206/315.5 |
| 5,038,984 | A | * | 8/1991 | Izzo | 224/643 |
| 5,096,059 | A | * | 3/1992 | Henderson | 206/315.5 |
| 5,176,253 | A | | 1/1993 | Perrin | |
| 5,402,883 | A | * | 4/1995 | Shin | 206/315.3 |
| 5,465,839 | A | * | 11/1995 | Gretz | 206/315.3 |
| 5,560,479 | A | | 10/1996 | Leyba | |
| 5,570,495 | A | | 11/1996 | Mogell | |
| 5,632,496 | A | * | 5/1997 | Nelson | 280/30 |
| 6,220,432 | B1 | | 4/2001 | Tan | |

FOREIGN PATENT DOCUMENTS

JP 2002085610 A * 3/2002 ..... A63B/55/00

* cited by examiner

*Primary Examiner*—Sue A. Weaver
(74) *Attorney, Agent, or Firm*—Cahill, von Hellens & Glazer P.L.C.

(57) ABSTRACT

A golf bag is comprised of a base bag including a tube having an open top and a closed bottom and a detachable overcoat; The overcoat surrounds the tube and is attached to it by a first zipper circumferentially attached to an upper portion of the tube, a second zipper circumferentially attached to a lower portion of the tube, and a third zipper attached to a vertical edge of the overcoat. The overcoat can be embroidered or screen printed, attached to the base bag, or detached from the base bag and another overcoat of a different color or style can be attached to the same base bag.

14 Claims, 7 Drawing Sheets

EMBROIDERABLE GOLF BAG AND METHOD

BACKGROUND OF THE INVENTION

1. Field of the Invention

This invention relates to a golf bag, more specifically a golf bag which facilitates embroidery, screen printing or other logo affixation methods in multiple locations. By way of definition, the terms "embroidering, embroider and embroidered" are used herein to cover embroidery, screen printing, embossing and other imprinting methods. The outer overcoat, which can include pockets, is removed and placed in any embroidery machine, the logo (s) are embroidered and then the overcoat is reattached.

2. Discussion of Prior Art

Golf and business enjoy a close relationship. The golf course is a popular place to do business and establish relationships. With golf and business crossing paths in many areas, golf products have become a way of advertising for many companies.

It is conventional practice to embroider or silk screen designs, such as logos, on a wide variety of articles, such as golf bags. The design can be used either for decoration, personal identification, commercial exploitation, or a combination of these functions. Articles which are seen commonly by many can be commercially used to advertise or promote a commercial name, product or design. Golf bags accomplish this goal very well, since they are seen by many people while on a golf course or practice area.

Conventional golf bag structures consist of a main central hollow tube having an outer wall, an open top and a closed bottom for carrying golf clubs therein. Integrally connected to the outer wall of the tube is a shoulder strap and handle to carry the golf bag, and pockets to carry golf accessories and personal items. To apply a design on such a structure, the hard plastic top and bottom, rigid or soft tube and overall size interfere with the embroidery or silk screening machinery and therefore greatly slow the embroidery or silk screening process or make it impossible to apply the design.

With this in mind, the cost of embroidering or silk screening a commercial quantity of golf bags is higher than desirable because of the handling requirements during the logoing process. For instance, it may be necessary manually place one or two golf bags at one time on the machine, instead of six, twelve or even twenty-four.

The original methods for affixing insignias or logos to a golf bag are inefficient and costly. Golf bags can be embroidered before they are assembled, however this is inefficient due to the amount of required production time and can only be done at the factory.

Another prior technique uses an embroidery machine designed specifically to embroider golf bags. This is expensive and inefficient. Only four golf bags can be embroidered at the same time. Therefore the price is higher than desirable and only a few such machines have been purchased.

Until now, U.S. Pat. No. 5,560,479 which features a single walled panel that zips off of the golf bag and can be embroidered and reattached to the golf bag was the best solution This still didn't solve the problem of embroidering in multiple locations or having an option as to where the logo should be attached. The removable single walled panel only fits the bag it was removed from. If damaged during embroidery, the entire golf bag is ruined. Most embroiderers damage 2%–3% of embroidered products. For this reason, many embroiderers refuse to embroider this type of bag.

Although various methods exist for applying a design on a golf bag, there is an unmet need for a golf bag structure and method which provide the capability of enabling commercial quantities of design bearing golf bags to be manufactured in an economical manner.

Applying logos to products is of key importance to the promotional golf products industry. Therefore, there is an unmet need for a golf bag that can be easily embroidered by standard embroidery machines.

SUMMARY OF THE INVENTION

Accordingly, it is an object of the invention to provide a golf bag that can be embroidered by anyone with a basic embroidery machine, with no need for special equipment.

It is also an object of the invention to eliminate long production time for custom golf bags.

It is also an object of the invention to provide a process of embroidering or silk screening golf bag overcoats which enables a maximum of machine automation and minimizes manual handling in the process.

It is also an object of the invention to provide a method to embroider or screen print a golf bag in multiple locations.

It is also an object of the invention to provide a golf bag with a universal fitting overcoat that can be removed and reattached to any golf bag for the purpose of embroidery, replacing damaged overcoats or base bags, changing the color or changing the style of the golf bag, all by replacing the overcoat.

It is also an object of the invention to reduce the amount of required inventory of fully assembled golf bags by providing a golf bag that can accommodate several styles and numerous colors wherein the manufacturer does not need to stock a large number of golf bags of different colors and styles.

Briefly described, and in accordance with one embodiment, the present invention provides a golf bag designed to facilitate affixation of logos or other indicia to the golf bag via a detachable overcoat. The overcoat consists of the outer material of the golf bag; including all pockets, which easily attaches and detaches from the base bag, thus providing an easy, fast and cost effective method for logoing golf bags in multiple locations with standard embroidery equipment, or the like.

DETAILED DESCRIPTION OF THE PREFERRED EMBODIMENTS

Referring to FIGS. 1–8, a golf bag is described having a removable overcoat for facilitating the affixation of logos or names by embroidery, screen printing or the like.

Figure 1:
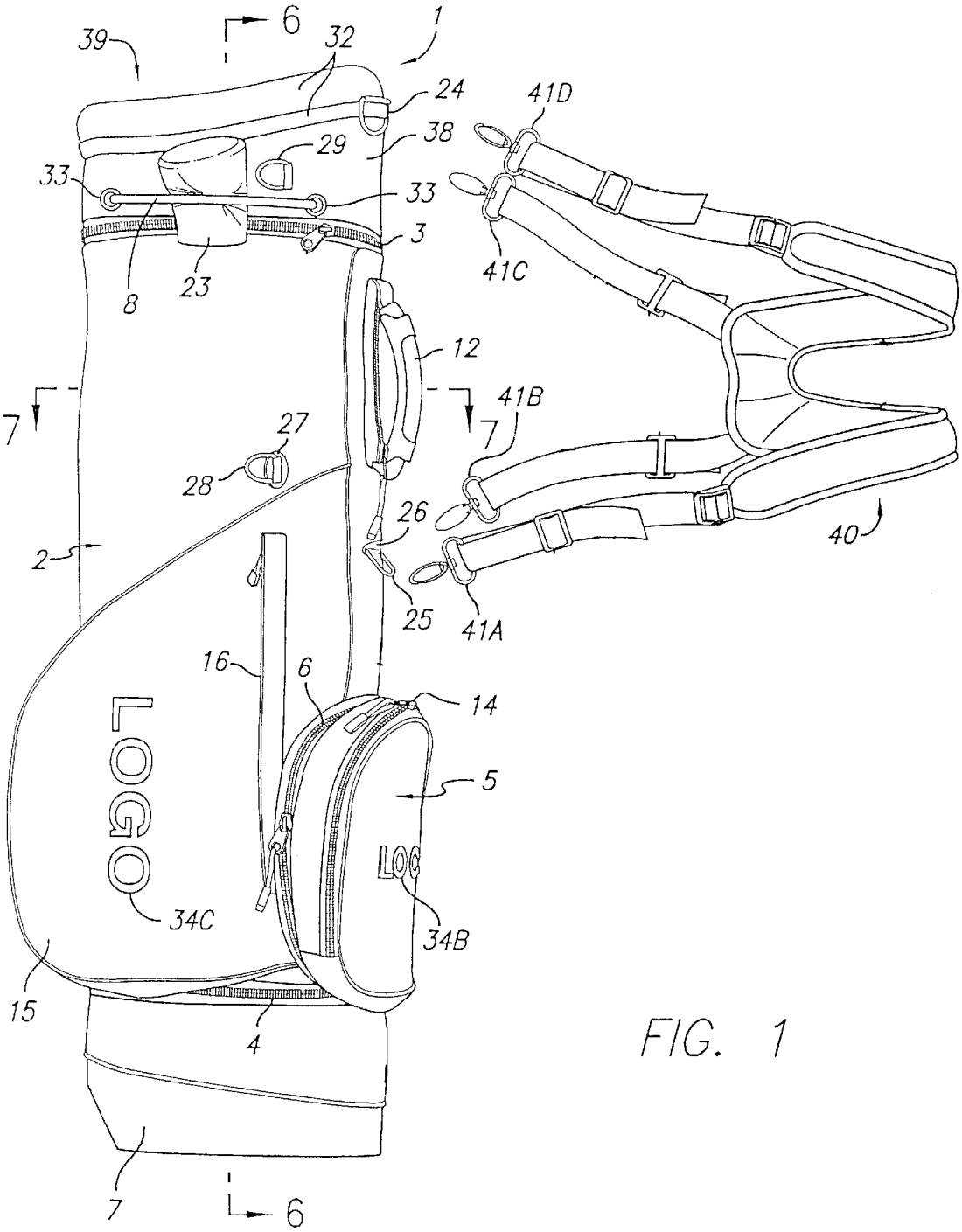
FIG. 1 is a perspective view of the assembled golf bag.

The Golf bag, like traditional golf bags, has a generally cylindrical storage tube or chamber which attaches to a rigid top 38 and a bottom 7 made of plastic, metal, wood or the like as shown in FIG. 1. The tube consists of an open top 39 and a closed bottom. The cylindrical top opening allows for the easy insertion and removal of golf clubs which are stored in the tube. The top can have dividers 35A, B, which dissect the cylindrical opening to organize the golf clubs. The bottom of the golf bag has a similar shape to the top, however the bottom is closed with a flat base. It is made using the same material as the top, usually hard plastic.

Figure 6:
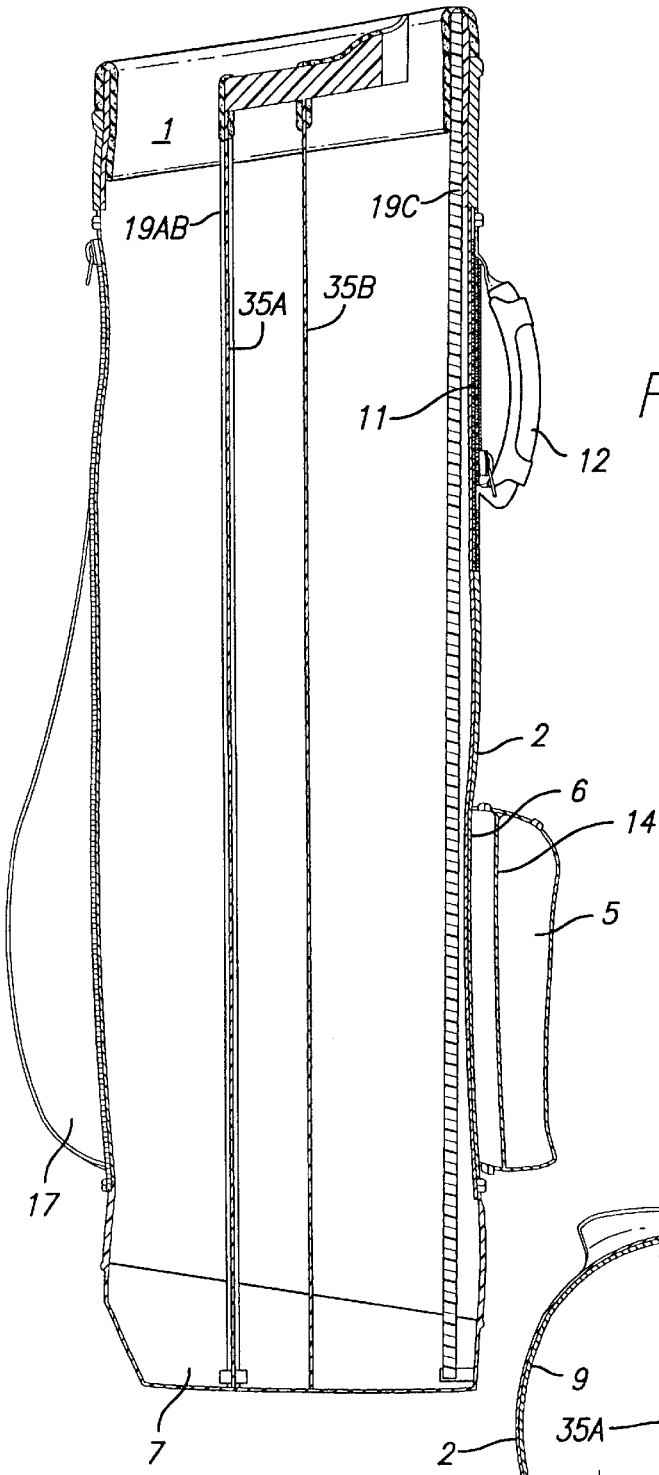
FIG. 6 is a cut away perspective view of the assembled golf bag.
Figure 7:
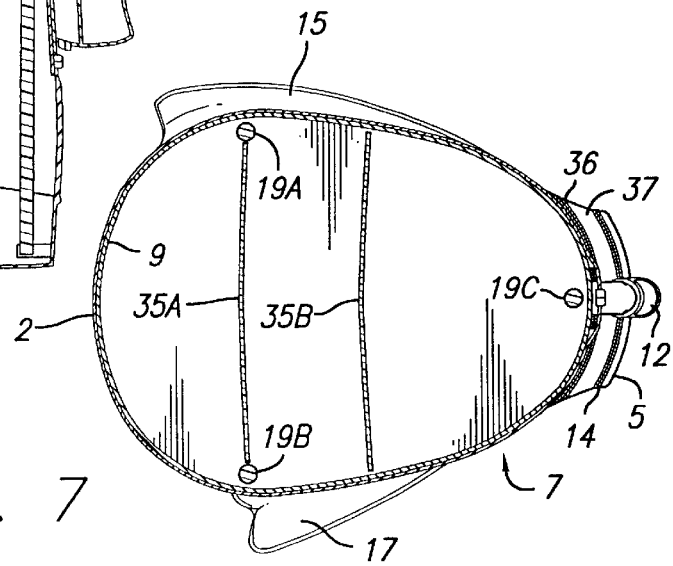
FIG. 7 is a cut away top down view of the assembled golf bag.

The top 32, as shown in the cut-away of FIG. 6, and bottom 7 are connected by three metal stays 19A–C which form the structure of the tube. They are located inside the tube material 9. Several methods can be used to form a hollow tube, this is only one method. Other suitable structures can include rigid plastic tubes, or a light material covering metal or wood stays. One or more stays can be used.

The tubular part of the bag forms its body, where numerous pockets are attached in predetermined locations for storing and organizing personal items and golf accessories. These pockets are opened and closed with zippers, however other methods can be used, such as snaps, Velcro and other fastening methods.

The shoulder strap 40, preferably padded, attach to the strap attachments 24, 25, 28, 29 on a golf bag and offer a way to carry the golf bag over one or both shoulders. Both the top and the bottom of the strap have metal clips 41A–D which attach to the metal D—ring strap attachments. Other methods of attaching straps are possible such as clips, clasps, buckles and the like. There is also a rubber carrying handle 12 to help lift the bag when the shoulder strap is not used. It is attached to the longitudinal side of the golf bag, usually between the two strap attachments on the spine of the bag.

Many light-weight bags have an automatic stand which attaches to the top and bottom of the bag, on the back side of the cylindrical tube. (Not Shown) When the bag is removed from ones shoulder, and the bottom is placed on the ground, the stand will automatically open, forming a tripod and the bag will stand at about a 50 degree angle, so the open end of the bag is ready to have clubs inserted. This stand is well known in the industry and not necessary to this invention, but can be used in conjunction with the golf bag described herein.

Unlike conventional golf bags where the tube consisting of the storage pockets is permanently connected to the top and bottom of the bag, this golf bag provides the combination of two integral parts, the base bag 1 and the overcoat 2.

Figure 2:
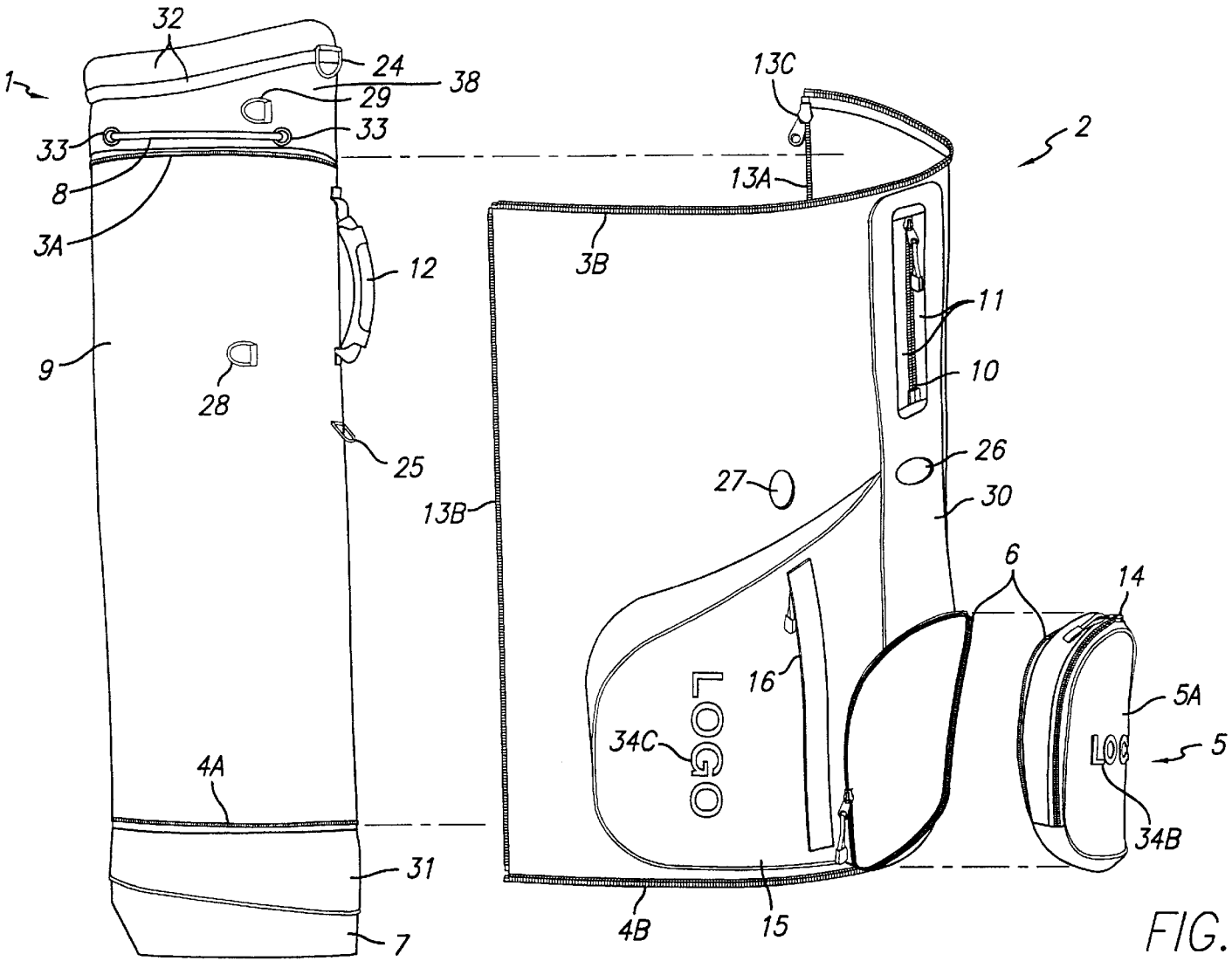
FIG. 2 is an exploded view of the base bag, the overcoat and the removable pocket.

FIG. 2 is the exploded view which best shows the integral components of the invention. The two main integral parts are the base bag 1 which comprises of a main central hollow tube having an outer wall of thin material 9, such as nylon, polyester or any lightweight durable material, an open top 39 and a closed bottom 7 for carrying golf clubs therein.

Figure 5:
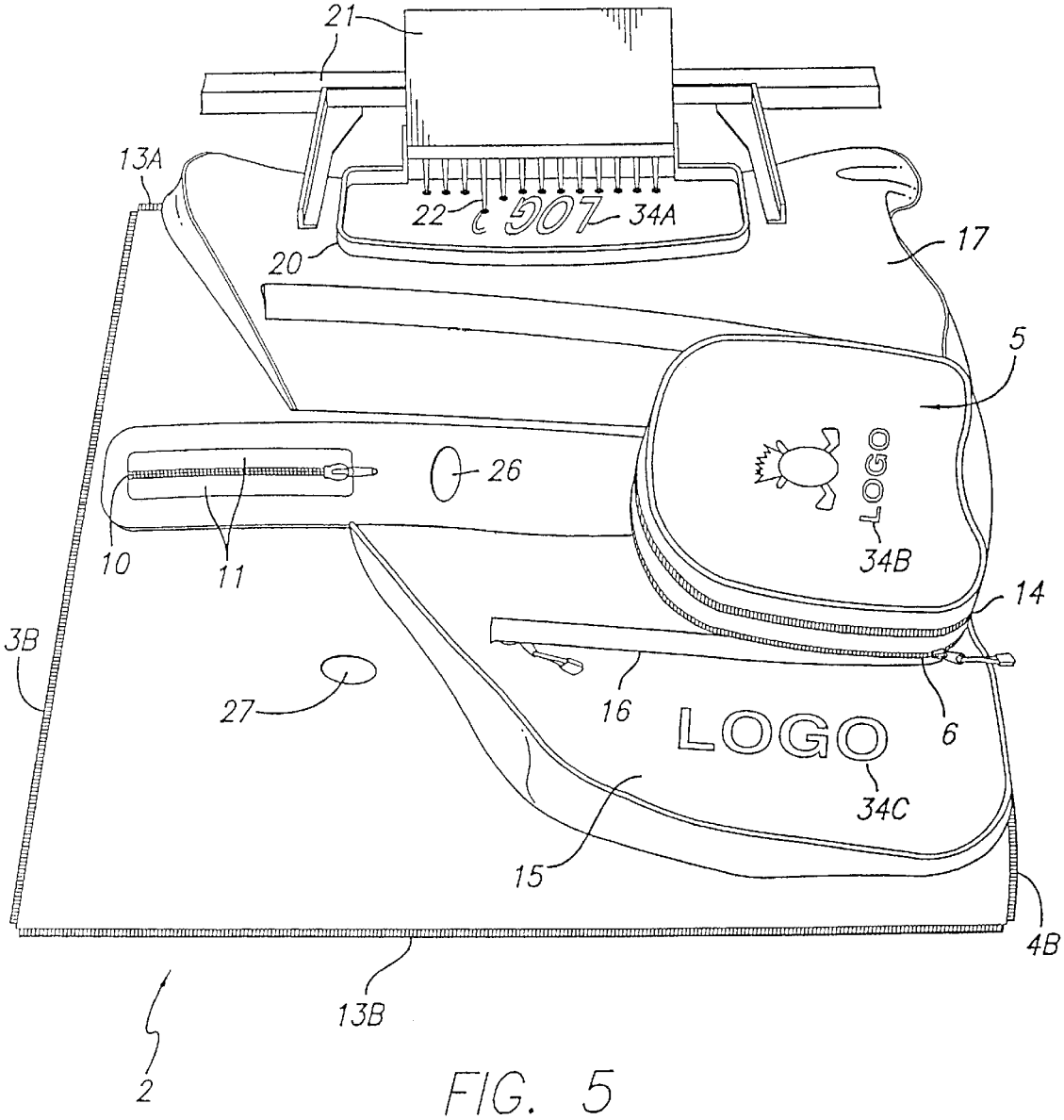
FIG. 5 is a plan view of the overcoat fully removed from the base bag, laid flat and shown in an embroidery machine.

Referring especially to FIG. 2/FIG. 5. One embodiment of the golf bag includes the removable overcoat 2 which is made using nylon, polyester or any durable material. The overcoat 2 is made up of rectangular piece of material which fits exactly onto the base bag. The shape doesn't have to be rectangular, but conforms to the exact shape that the base bag is designed for. The overcoat 2 consists of several pockets 5, 15, 17 for storage of golf accessories and personal items on the outside of the overcoat. They are located at predetermined locations, however pockets can be placed in any pattern. These pockets are opened and closed by zippers 14 and 16. It is contemplated, however, that the pockets can be opened and closed by many other fastening mechanisms such as snaps, clips, Velcro, and the like.

Referring especially to FIG. 2. For the golf bag assembly, the zipper opening 11 on the overcoat 2 is opened so the two sides of the zipper detach are completely separated. The opening is aligned with the handle 12 on the base bag 1. The handle is pulled through the opening and the two sides of the zipper 10 are tucked under the handle, pulled together, reconnected and zip 10 closed, thus securing the handle 12 on the outside of the overcoat 2.

Figure 4:
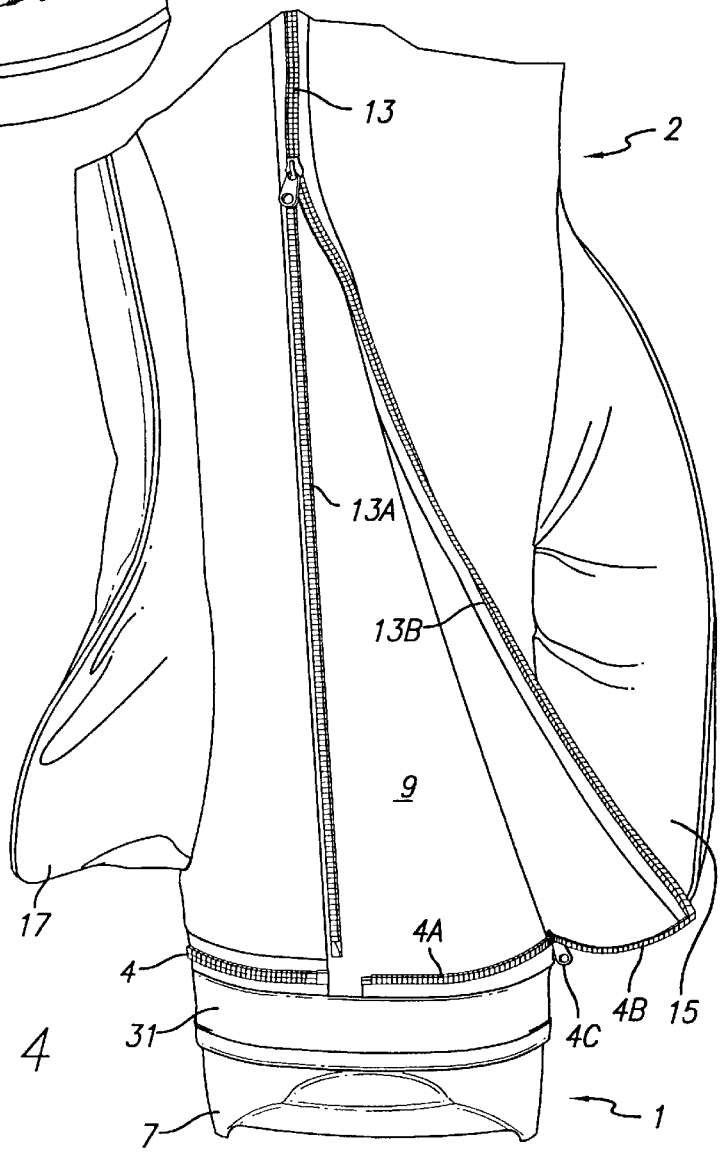
FIG. 4 is a rear view of the base bag with the overcoat partially detached.

The overcoat 2 has zippers on all four edges 3B, 4B, 13A, B. The zippers 3B, 4B attach to the zippers 3A, 4A on the base bag 1, and are closed using zipper pullers 3C, 4C repectivly. It should be noted that it could be attached in other methods such as snaps, Velcro or other fastening mechanisms. The zippers 3A, B and 4A, B have the exact same number of zipper teeth. By using this type of zipper, it can be determined that the overcoat 2 will have an exact fit onto any base bag. As seen in FIG. 4, the zippers start at the back of the base bag 1, and zip around the circumference of the tube 9 and end next to the starting point. They start and end at the back only for aesthetic purposes, however for function, they can begin and end in any position on the bag. Once the two zippers 3, 4 are attached, top and bottom, the zippers 13A, B on the back edges of the overcoat 2 meet and are zipped together using zipper puller 13C, thus completing the main assembly of the base bag 1 and overcoat 2.

Referring to FIG. 2, The base bag 1 contains all of the structural components of the golf bag including the handle (s) 12 and shoulder strap 40. Structural components could be located on the overcoat, but unnecessary stress will be placed on the zippers which attach the overcoat to the base bag. The overcoat 2 overlaps the tube 9 of the base bag 1, two of the strap attachments 25, 28 and the rubber handle 12, are accessed through openings in the overcoat 2 when the bag is assembled. The handle 12 is used to lift the bag when it is not carried by the shoulder strap.

The strap attachments 24, 25, 28, 29 are metal D-rings, however there are several methods to attach shoulder straps to golf bags including plastic clips, buckles, loops, clasps, rivets and the like. When the overcoat 2 and base bag 1 are assembled, two strap attachments 25, 28 are accessed through two separate holes 26, 27 in the overcoat. The strap attachments are pulled through the holes so they sit on the outside of the overcoat and the shoulder strap 40 can be attached, as seen in FIG. 1 which shows the fully assembled golf bag.

Two strap attachments located on the top of the golf bag 24, 29 are metal D-rings not covered by the overcoat. This golf bag can use a traditional single shoulder strap (not shown), which connects to the bag in two locations along the longitudinal side 24, 25 or a dual strap shown, that attaches in three or four points on the bag.

This dual strap 40 attaches to the bag at four points, and is worn over one or both shoulders when carrying the golf bag. It can be adjusted to fit different sized people. The golf bag hangs like a backpack behind the golfer. It uses the same two strap attachments on the longitudinal side of the bag as the single strap 24, 25, and two additional strap attachments 28, 29 on the side of the bag. The locations of the strap attachments can vary depending on the balance of the particular bag and the style of the shoulder strap. It should be noted that it is also possible to attach a strap with three connection points to this bag, whereby connecting two points to the traditional strap placement 24, 25 and the third to the handle 12. The type of strap used is a personal preference, and this bag accommodates any type of strap.

Figure 9:
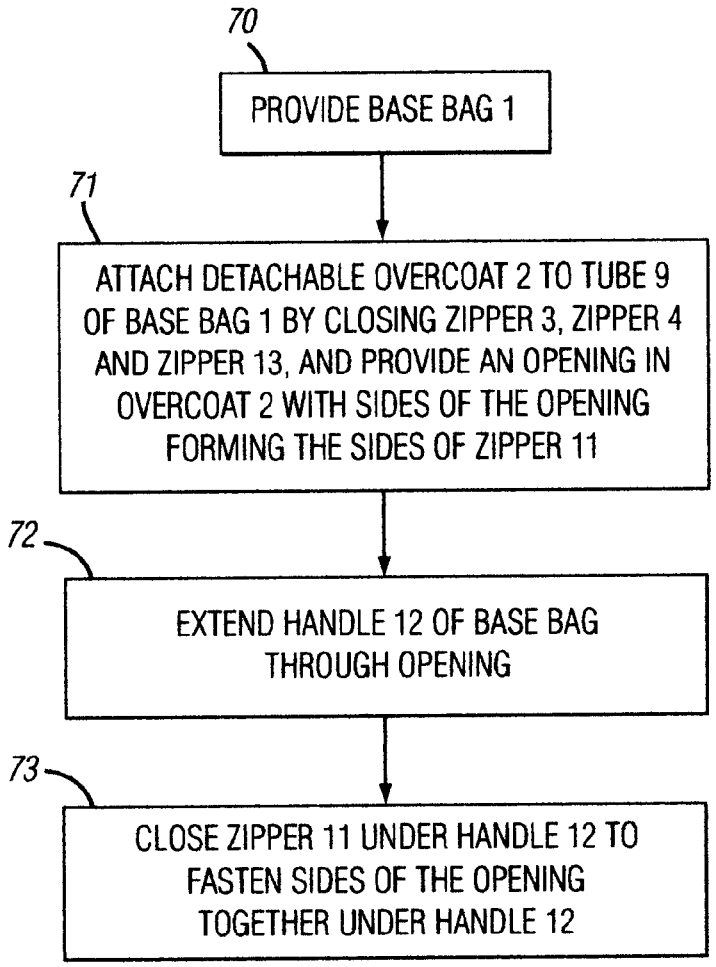
FIG. 9 is a flow chart useful in explaining another embodiment of the method of present invention.

The method of making the above described assembled golf bag is described next with reference to the flow chart of FIG. 9. The first step is to provide base bag 1, as indicated in block 70 of FIG. 9. Then, as indicated in block 71, overcoat 2 is attached to tube 9 of base bag 1 by closing zipper 3, zipper 4, and zipper 13, and by providing an opening in overcoat 2 aligned with handle 12, with the sides of the opening forming the sides of zipper 11. Then, as indicated in block 72, handle 12 of base bag 1 is extended through that opening. Then, as indicated in block 70 3, zipper 11 is closed under handle 12 to fasten the two sides of the opening together under handle 12.

FIG. 5 illustrates the overcoat 2 in an embroidery machine 21 comprising of a needle mechanism 22 and an embroidery hoop 20, so it can be stitched. It should be noted that there is another fixed component of the embroidery machine which is not shown. The bobbin arm holds the bobbin and must be inserted into the opening of the pocket of the golf bag, so only the outer wall of the golf bag pocket is sewn. FIG. 5 illustrates the overcoat in the machine, however, the overcoat would need to be rotated 180 degrees so the opening of the pocket 18 faces the machine and the bobbin arm can be inserted inside the pocket. An embroidery hoop is attached to the desired embroidery location. The overcoat is secured to the embroidery machine by the embroidery hoop which enables the overcoat to be moved easily relative to the needle mechanism. By synchronizing the movement of the work surface and the needle mechanism, designs like 34 A–C are easily produced by machinery having memorized designs.

A method of performing an embroidering process as shown in FIG. 5 first involves removing the overcoat 2 from the base bag 1. Alternatively, a commercial quantity of just overcoats can be brought to a location where the embroidery machines are located. The overcoats are fitted with embroidery hoops and placed in the embroidery machine. The machine advances in memorized movements in order for the needle to embroider a design precisely on any of the pockets of the overcoat. After the overcoats have been embroidered, they can be collected and reattached to the base bag.

The above golf bag structure and method of embroidering provides an economical and fast way to provide commercial quantities of embroidered golf bags.

Alternate design applying processes can be utilized. For instance, the design can be silk screened on to any of the pockets of the overcoat utilizing silk screening machinery known in the art.

Figure 3:
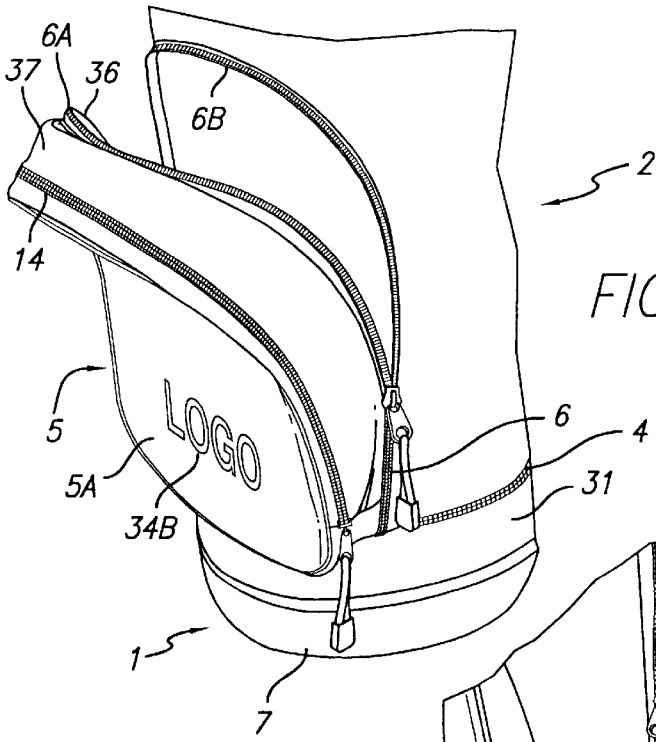
FIG. 3 is a detailed view of the removable pocket partially detached to the overcoat.

One embodiment as seen in FIG. 2, includes a pocket 5 which can be attached and removed. Removing the organizer facilitates the affixing of logos to the front single walled panel. Also the user can organize their personal belongings and remove it from the golf bag so as to have valuables with them. It is attached using the zipper 6 which runs around the periphery of the back single walled panel as seen in FIG. 3. The pocket forms its own bag 5 and has two single walled panels, front 5A and back 36, which are connected along their peripheries by a side wall 37. It has a zipper opening to access the inside of the pocket 14. The zipper 6 attaching the pocket to the overcoat 2 is located along the back panel's peripheral edge. There are several methods of possible attachment for this pocket such as Velcro, snaps, buckles, clips and the like. It can also be attached using a combination of these methods. It should also be noted that this pocket doesn't only have to attach to the overcoat 2, but as a pocket on any traditional golf bag. The pocket can be in any shape or size and be located in numerous locations on the outside of the golf bag. It is also possible to have multiple removable pockets on any one golf bag.

Another embodiment of the golf bag includes the catch all bungee 8 as seen in FIG. 1. It is formed with a round length of bungee cord which is inserted into two small round openings 33 drilled through the side of the plastic top 38. The bungee is inserted through the holes and tied on the inside of the plastic top, securing the length of the cord on the outside of the bag. The bungee cord holds objects such as head covers 23, towels and other items to be temporarily secured to the bag.

The cut-away cross sectional view in FIG. 6 shows the overcoat 2 covering the base bag 1 and shows the inside of the hollow tube compartment where the golf clubs are stored. The two thin material golf club dividers 35A–B located inside the tube cut the diameter of the tube into sections and run from the top of the golf bag to the bottom, thus creating separate compartments to keep the golf clubs organized. Looking at the dividers from the top of golf bag as in FIG. 7, they create three sections to store golf clubs. Dividers are found on most golf bags, however the number of dividers varies from none to fourteen.

Figure 8:
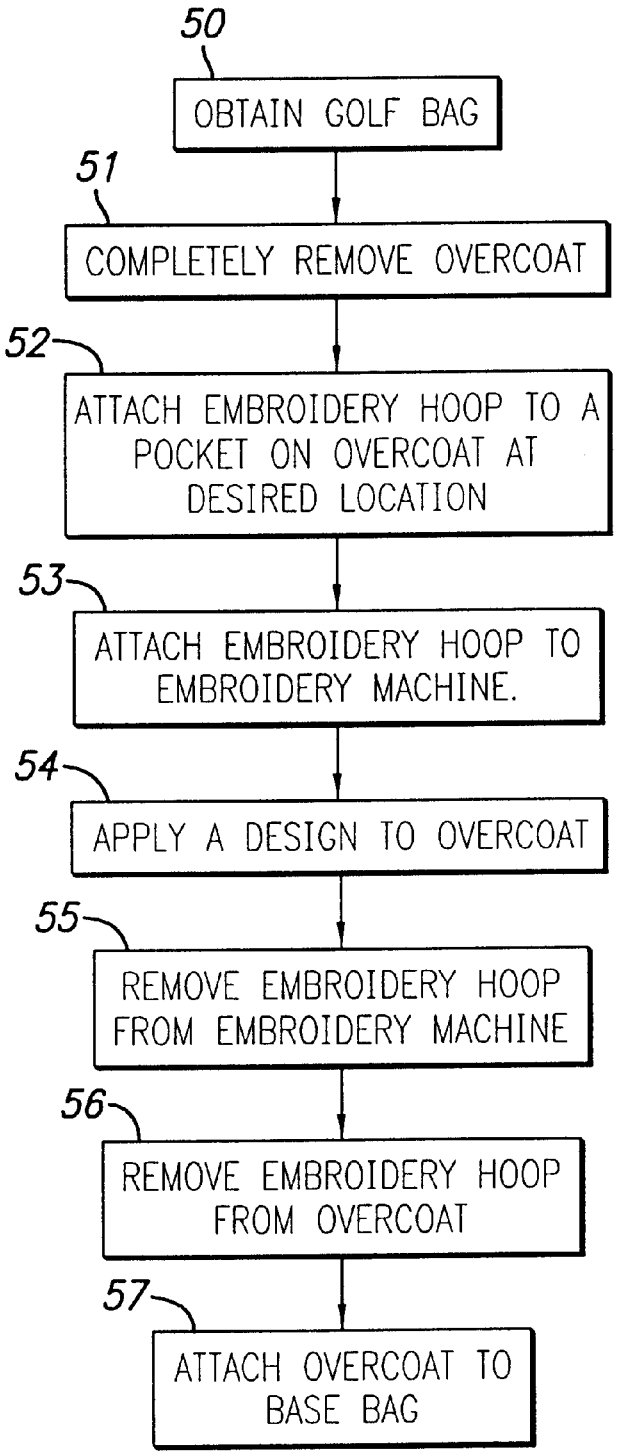
FIG. 8 is a flow chart useful in explaining one embodiment of the method of the present invention.

The method for the process described above can be summarized in eight steps. Refer to FIG. 8. When the golf bag is obtained as shown in block 50, the overcoat is removed and separated from the bag 51. The desired number of overcoats are taken to the embroidery machine and embroidery hoops are attached to the desired location 52 of the logo. It should be noted that the overcoats may be manufactured apart from the base bag, so steps one and two may not be necessary. The overcoat could be united with the base bag for the first time after embroidery.

The embroidery hoop is secured in the machine 53. Between one and 24 may be placed in the machine at the same time, depending on the capabilities of the machine. The machine is started and the predetermined logo is applied to the desired location on the overcoat 54. The hoops and overcoats are removed from the machine 55 and the hoops are removed from the overcoat 56.

This process may be repeated for logos in other locations on the overcoat. The overcoat is then attached to any of the base bags 57. It is a universal fit, so the overcoat doesn't need to be reattached to the bag it was removed from.

It should also be noted that this could also be used for other methods of affixing logos, such as screen printing, embossing and the like. The embroidery, screen printing procedures for items such as shirts, towels are well known to those skilled in the industry. The logo affixation process for the overcoat is no different once it is removed from the base bag.

The present invention described herein may be designed in many different configurations. While the present invention has been described in terms of a specific embodiment, other embodiments may come into mind to those skilled in the art without departing from the spirit and scope of the present invention. Obviously, any suitable materials may be used and variations may occur. It could be possible for someone skilled in the art to use this concept and design around this patent by changing certain embodiments in order to work around the present invention. For example, if a spiral zipper path were used, the total number of zippers used to connect the overcoat to the base bag could be one or two. It could also be connected using more than three. It could also connect using a different method than a zipper and on different places on the bag, closer or farther from the top or bottom. The shape and size of the overcoat could also vary from the drawings. The overcoat could also attach to the base bag, but not zip to itself on the back, but zip directly to the base bag. This would require two or more locations, but it would work. Another design around could have the overcoat covering only part of the base bag and/or having pockets attached to both the base bag and the overcoat.

All of these possible design arounds are based on the same concept of completely removing an outer shell (overcoat) from the base bag. That is the basis of the invention. The invention should, therefore, be measured in terms of the claims which follow.

What is claimed is:

1. A golf bag comprising:

(a) a base bag including a tube having an open top and a closed bottom, wherein golf clubs can be placed into the tube;

(b) a detachable overcoat surrounding and attached to the tube;

(c) a first zipper having a first tooth section circumferentially attached to an upper portion of the tube, a second tooth section attached along an upper edge of the overcoat, and a first slide movable to lock teeth of first and second tooth sections together to attach the upper edge of the overcoat to the upper portion of the tube and also movable to unlock teeth of the first and second tooth sections to release the upper edge of the overcoat from the upper portion of the tube;

(d) a second zipper having a third tooth section circumferentially attached to an lower portion of the tube, a fourth tooth section attached along a lower edge of the overcoat, and a second slide movable to lock teeth of the third and fourth tooth sections together to attach the lower edge of the overcoat to the lower portion of the tube and also movable to unlock teeth of the third and fourth tooth sections to release the lower edge of the overcoat from the lower portion of the tube; and (e) a third zipper having a fifth tooth section attached to a first vertical edge of the overcoat, a sixth tooth section attached to a second vertical edge of the overcoat, and a third slide movable to lock teeth of the fifth and sixth tooth sections together to close the overcoat around the tube and also movable to unlock teeth of the fifth and sixth tooth sections to allow detachment of the overcoat from the tube, wherein the base bag includes a handle, and the overcoat includes an opening through which the handle extends, and a zipper including a removable slide that engages each of a first handle opening tooth section attached to a first side of the opening and a second opening tooth section attached to a second side of the opening to close the opening after the handle has been extended through the opening.

2. The golf bag of claim 1 wherein the overcoat is composed of a piece of flexible material that is generally rectangular when flattened out.

3. The golf bag of claim 1 including a design embroidered onto an outer surface of the overcoat before the overcoat is attached to the tube by means of the first, second, and third zippers.

4. The golf bag of claim 1 wherein a design is embroidered onto an outer surface of an accessory pocket attached to an outer surface of the overcoat.

5. The golf bag of claim 4 wherein the accessory pocket is permanently attached to the outer surface of the overcoat.

6. The golf bag of claim 4 wherein the accessory pocket is removably attached to the outer surface of the overcoat by means of a fourth zipper.

7. The golf bag of claim 6 wherein the design is embroidered onto the outer surface of the accessory pocket before the accessory pocket is attached to the outer surface of the overcoat by means of the fourth zipper.

8. The golf bag of claim 1 wherein the overcoat is composed of nylon material.

9. The golf bag of claim 1 wherein the overcoat is composed of polyester material.

10. A method of making a golf bag. comprising:

(a) providing a base bag including a tube having an open top and a closed bottom, wherein golf clubs can be placed into the tube;

(b) attaching a detachable overcoat to the tube so that the overcoat surrounds the tube by i. closing a first zipper having a first tooth section circumferentially attached to an upper portion of the tube, a second tooth section attached along an upper edge of the overcoat, and a first slide movable to lock teeth of first and second tooth sections together to attach the upper edge of the overcoat to the upper portion of the tube and also movable to unlock teeth of the first and second tooth sections to release the upper edge of the overcoat from the upper portion of the tube.

ii. closing a second zipper having a third tooth section circumferentially attached to an lower portion of the tube, a fourth tooth section attached along a lower edge of the overcoat, and a second slide movable to lock teeth of the third and fourth tooth sections together to attach the lower edge of the overcoat to the lower portion of the tube and also movable to unlock teeth of the third and fourth tooth sections to release the lower edge of the overcoat from the lower portion of the tube, and iii. closing a third zipper having a fifth tooth section attached to a first vertical edge of the overcoat, a sixth tooth section attached to a second vertical edge of the overcoat, and a third slide movable to lock teeth of the fifth and sixth tooth sections together to close the overcoat around the tube and also movable to unlock teeth of the fifth and sixth tooth sections to allow detachment of the overcoat from the tube, wherein the base bag includes a handle, the method including forming a opening in the overcoat through which the handle can extend, and closing a zipper including a removable slide that engages each of a first opening tooth section attached to one side of the opening and a second opening tooth section attached to a second side of the opening after the handle has been extended through the opening.

11. The method of claim 10 including embroidering a design onto an outer surface of the overcoat before the overcoat is attached to the tube.

12. The method of claim 11 including embroidering the design by means of an embroidery machine.

13. The method of claim 11 including embroidering a design onto an outer surface on accessory pocket attached to an outer surface of the overcoat wherein a design is embroidered onto an outer surface of an accessory pocket for attachment to an outer surface of the overcoat.

14. The method of claim 10 including removing the overcoat from the tube by opening the first, second, and third zippers, and replacing the overcoat with another overcoat.

* * * * *